US008277242B1

(12) United States Patent
Sun et al.

(10) Patent No.: US 8,277,242 B1
(45) Date of Patent: Oct. 2, 2012

(54) CONNECTOR RETAINING DEVICE HAVING CLAMPING PLATES SANDWICHING EACH OTHER

(75) Inventors: Zheng-Heng Sun, New Taipei (TW); Li-Ren Fu, Shenzhen (CN); Jun-Hui Wang, Shenzhen (CN); Ai-Ling He, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/172,866

(22) Filed: Jun. 30, 2011

(30) Foreign Application Priority Data

Apr. 27, 2011 (CN) ..... 2011 2 0127634

(51) Int. Cl.
*H01R 13/639* (2006.01)

(52) U.S. Cl. ..... 439/345

(58) Field of Classification Search ..... 439/345, 439/371, 372, 701
See application file for complete search history.

(56) References Cited

U.S. PATENT DOCUMENTS

| | | | | |
|---|---|---|---|---|
| 6,398,579 | B1 * | 6/2002 | Banas et al. | 439/372 |
| 7,056,138 | B2 * | 6/2006 | Lewis et al. | 439/296 |
| 7,938,671 | B2 * | 5/2011 | Hayden, Sr. | 439/371 |
| 2008/0194133 | A1 * | 8/2008 | Kramer | 439/345 |
| 2010/0178789 | A1 * | 7/2010 | Ohmori et al. | 439/345 |
| 2010/0248555 | A1 * | 9/2010 | Ma et al. | 439/701 |
| 2011/0300733 | A1 * | 12/2011 | Janarthanam et al. | 439/304 |
| 2012/0015541 | A1 * | 1/2012 | Lu | 439/345 |

* cited by examiner

*Primary Examiner* — Chandrika Prasad
(74) *Attorney, Agent, or Firm* — Altis Law Group, Inc.

(57) ABSTRACT

A connector retaining device includes a first retaining frame and a similar second retaining frame. The first retaining frame includes two parallel first clamping plates, a first front opening at a front side thereof between the first clamping plates, a first rear plate at a rear side, a first side plate at one lateral side, and a first side opening at another lateral side. The first rear plate defines a first slot exposed at said another lateral side. The first clamping plates are configured for sandwiching a first connector. The first front opening is configured for allowing insertion of a second connector into the first retaining frame to engage with the first connector. The first side opening is configured for allowing insertion of the first connector into the first retaining frame. And the first slot is configured for allowing the first cable to extend and slide therethrough.

2 Claims, 3 Drawing Sheets

CONNECTOR RETAINING DEVICE HAVING CLAMPING PLATES SANDWICHING EACH OTHER

CROSS-REFERENCE TO RELATED APPLICATION

This application is related to two commonly-assigned co-pending applications both entitled "CONNECTOR RETAINING DEVICE" Ser. Nos. 13/172,877 and 13/172,883. The disclosure of the above-identified applications are incorporated herein by references.

BACKGROUND

1. Technical Field

The present disclosure relates to connector retaining devices, and particularly, relates to a connector retaining device for retaining interconnection between two connector cords.

2. Description of Related Art

In the cable connecting field, a connector retaining device typically includes a first connector and a second connector each connected to cable, the first connector and the second connector are coupled with each other for interconnecting the cables.

The first connector and the second connector are connected to each other just by inserting the first connector into the second connector, however the connection has no other support. The first connector and the second connector may be pulled apart from each other by main force, or by unexpected collisions with other objects.

What is needed therefore is a connector retaining device addressing the limitations described.

BRIEF DESCRIPTION OF THE DRAWINGS

The components of the drawings are not necessarily drawn to scale, the emphasis instead being placed upon clearly illustrating the principles of the embodiments of the connector retaining device. Moreover, in the drawings, like reference numerals designate corresponding parts throughout several views.

DETAILED DESCRIPTION

Figure 1:
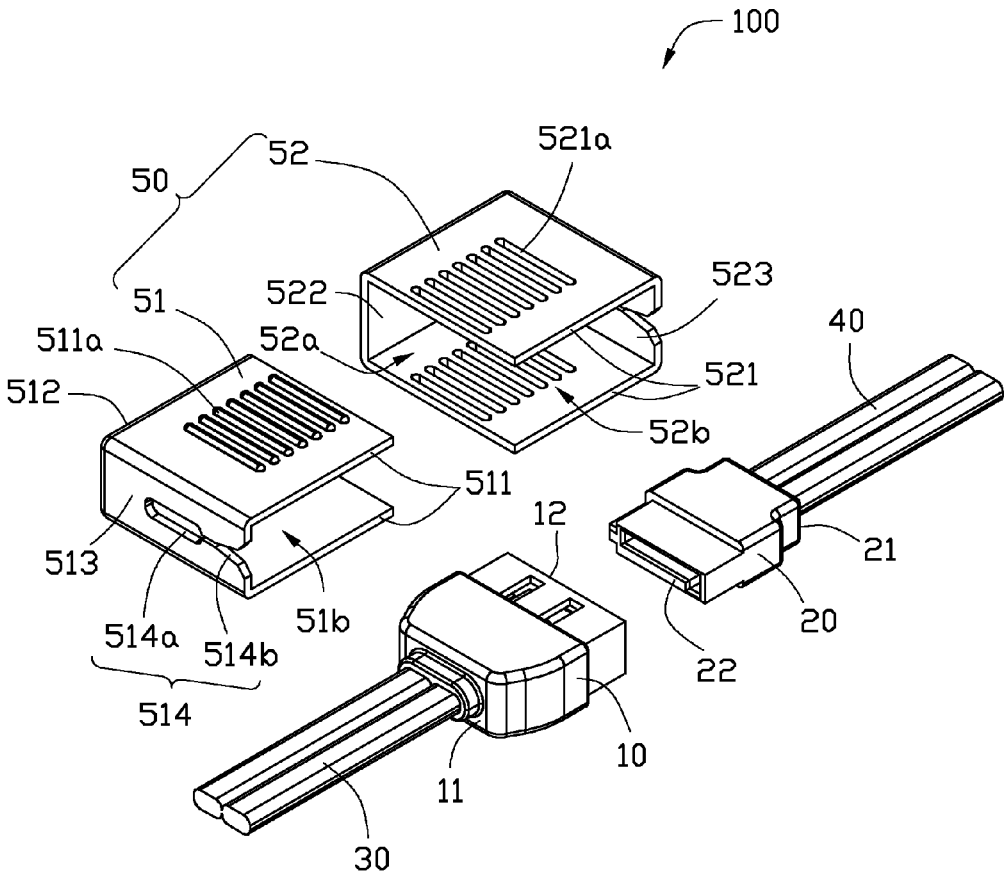
FIG. 1 is an exploded view of a connector retaining device, according to an exemplary embodiment of the present disclosure.
Figure 2:
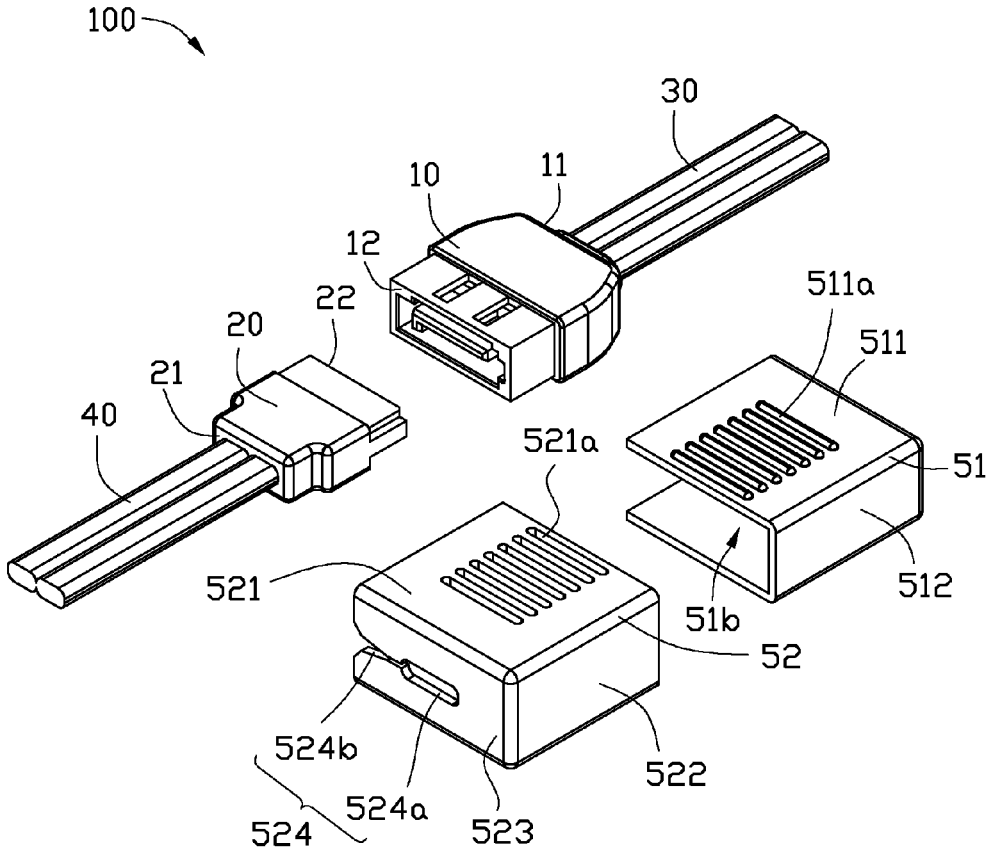
FIG. 2 is similar to FIG. 1, but viewing the connector retaining device from another angle.
Figure 3:
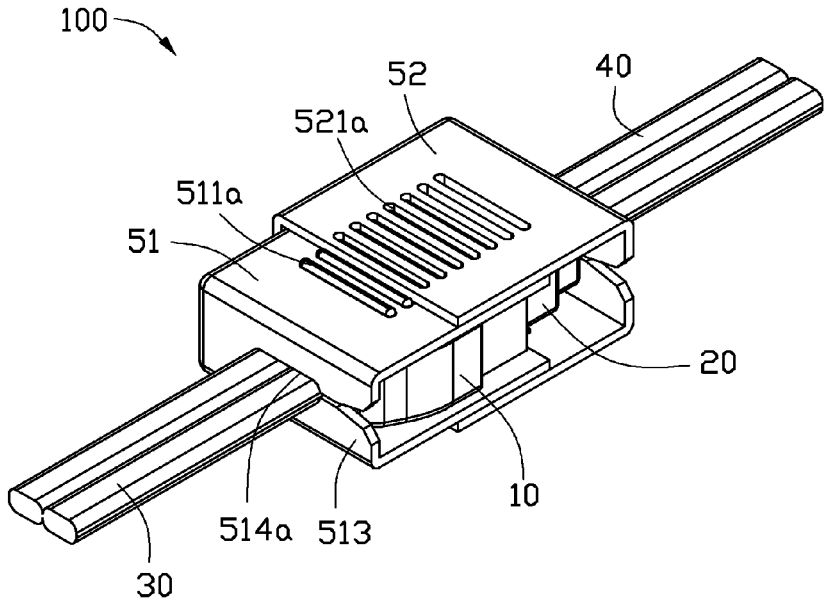
FIG. 3 is an assembled view of FIG. 1.

Referring to the FIGS. 1-2, a connector retaining device 100, according to an exemplary embodiment, is shown. The connector retaining device 100 includes a first connector 10, a second connector 20, a first cable 30, a second cable 40 and a security member 50.

The first connector 10 includes a first connecting end 11 and a first insertion end 12 opposite to the first connecting end 11. The second connector 20 includes a second connecting end 21 and a second insertion end 22 opposite to the second connecting end 21.

The first cable 30 is connected to the first connecting end 11 of the first connector 10. The second cable 40 is connected to the second connecting end 21 of the second connector 20. Thus the first connector 10 and the first cable 30 form a first connector cord (not labeled), and the second connector 20 and the second cable 40 form a second connector cord (not labeled). The first cable 30 and the second cable 40 can be power cables or data cables. In this embodiment, the first cable 30 and the second cable 40 are Serial Advance Technology Attachment (SATA) cables, and the first connector 10 and the second connector 20 are SATA connectors.

The securing member 50 includes a first retaining frame 51 and a second retaining frame 52. The first retaining frame 51 includes two first clamping plates 511, a first side plate 512 and a first rear plate 513. The first clamping plates 511 are substantially parallel to each other, the first side plate 512 and the first rear plate 513 are connected to the first clamping plates 511 and substantially perpendicular to the first clamping plates 511. The first side plate 512 and the first rear plate 513 are connected to each other and substantially perpendicular to each other. The first clamping plates 511 and the first side plate 512 define a first front opening 51*a* at a front side of the first retaining frame 51. The first clamping plates 511 and the first rear plate 513 define a first side opening 51*b* at a lateral side of the first retaining plate 51. The first clamping plates 511 each include a number of elongated protrusions 511*a*. The protrusions 511*a* protrude out from the surfaces of the first clamping plates 511 which are away from each other. The protrusions 511*a* are substantially parallel to each other and substantially parallel to the first rear plate 513. The first rear plate 513 defines a first slot 514 exposed at the lateral side of the first side opening 51*b*. The first slot 514 includes a receiving portion 514*a* and an entrance portion 514*b* communicating with the receiving portion 514*a*. The entrance portion 514 extends through an edge of the retaining plate 514, and the entrance portion 514 tapers inwards toward the receiving portion 514.

The second retaining frame 52 in similar to the first retaining frame 51. The second retaining frame 52 includes two second clamping plates 521, a second side plate 522 and a second rear plate 523. The second clamping plates 521 and the second side plate 522 define a second front opening 52*a* at a front side of the second retaining frame 52. The second clamping plates 521 and the second rear plate 523 define a second side opening 52*b* at a lateral side of the second retaining plate 52. The second rear plate 523 defines a second slot 524 exposed at the lateral side of the second side opening 52*b*. The second slot 524 includes a receiving portion 524*a* and a entrance portion 524*b* communicating with the receiving portion 524*a*. In addition, the second clamping plates 521 each define a number of engaging slots 521*a* formed through the second clamping plates 521. The engaging slots 521*a* are substantially parallel to each other and substantially parallel to the second rear plate 523. The first retaining frame 51 and the second retaining frame 52 are made from elastic material, such as metal or rubber. The distance between the first clamping plates 511 of the first retaining frame 51 is smaller than that between the second clamping plates 521 of the second retaining frame 52. The slightly different distances between the outer surfaces of the engagement plate 511 of the first retaining frame 51 and between the inner surfaces of the engagement plate 521 of the second retaining frame 52 are such that one or both first clamping plates 511, 521 must elastically deform to allow the mating of the first clamping plates 511 with the second engagement plate 521.

Alternatively, the protrusions 511*a* can be formed on the outer surfaces of the engagement plate 521, and the engaging slots 521*a* can be transferred to engagement plate 511 or replaced by grooves which formed on the inner surfaces of the engagement plate 511 of the first retaining frame 51.

In assembly, the first connector 10 and the second connector are coupled for interconnecting the first cable 30 and the second cable 40. The first retaining frame 51 is placed over the first connector 10, the first cable 30 passes through the receiving portion 514*a* of the first slot 514 in the first rear plate 513. The second retaining frame 52 is placed over the second connector 20, the second cable 40 passes through the receiving portion 524*a* of the second slot 524 in the second rear plate 523. Thus, the first clamping plates 511 sandwich the first connector 10 therebetween, and the second clamping plates 521 sandwich the second connector 20 therebetween. The first restricting frame 51 and the second retaining frame 52 are pushed together manually. The protrusions 511*a* on the first clamping plates 511 engage corresponding engaging slots 521*a* in the second clamping plates 521. The number of the protrusion 511*a* which actually engage with the engaging slot 521*a* depends upon the degree of plate engagement required by the user.

The first retaining frame 51 and the second retaining frame 52 are connected to each other through the protrusions 511*a* and the engaging slots 521*a*, and the connected first connector 10 and second connector 20 are held in place between the first retaining frame 51 and the second retaining frame 52. The first rear plate 513, 523 respectively butt against the first connecting end 11 of the first connector 10 and the second connecting end 21 of the second connector 20 to reinforce the integrity as well as the strength of the connection between the first connector 10 and the second connector 20.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A connector retaining device for retaining interconnection between a first connector cord, and a second connector cord, the first connector cord having a first cable and a first connector, the second connector cord having a second cable and a second connector engaged with the first connector, the connector retaining device comprising:

a first retaining frame comprising two parallel first clamping plates, a first front opening at a front side thereof between the first clamping plates, a first rear plate at a rear side thereof, a first side plate at one lateral side thereof, and a first side opening at another lateral side thereof, the first rear plate defining a first slot exposed at said another lateral side, wherein the first rear plate is perpendicularly connected between the first clamping plates, the first side plate perpendicularly adjoins the first rear plate, the first side plate perpendicularly connected between the first clamping plates, the first clamping plates are configured for sandwiching the first connector therebetween, the first front opening is configured for allowing insertion of the second connector into the first retaining frame therethrough to engage with the first connector, the first side opening is configured for allowing insertion of the first connector into the first retaining frame therethrough, and the first slot is configured for allowing the first cable to extend therethrough and slide therein and therealong; and a second retaining frame comprising two parallel second clamping plates, a second front opening at a front side thereof between the second clamping plates, a second rear plate at a rear side thereof, a second side plate at one lateral side thereof, and a second side opening at another lateral side thereof, the second rear plate defining a second slot exposed at said another lateral side, wherein the second rear plate is perpendicularly connected between the second clamping plates, the second side plate perpendicularly adjoins the second rear plate, the second side plate perpendicularly connected between the second clamping plates, the second clamping plates are configured for firmly sandwiching the first clamping plates therebetween, the second front opening is configured for allowing insertion of the first retaining frame into the second retaining frame therethrough, the second side opening is configured for allowing insertion of the first retaining frame into the second retaining frame therethrough, and the second slot is configured for allowing the second cable to extend therethrough and slide therein and therealong.

2. The connector retaining device of claim 1, wherein the first retaining frame comprises a plurality of elongated protrusions formed on the first clamping plates, the second retaining frame comprises a plurality of engaging slots defined in the second clamping plates, the protrusions configured for engaging in corresponding engaging slots.

* * * * *